US010865988B2

(12) United States Patent
Jeon et al.

(10) Patent No.: US 10,865,988 B2
(45) Date of Patent: Dec. 15, 2020

(54) PLATE FOR SUPPORTING NOZZLE TUBES AND METHOD OF ASSEMBLING THE SAME

(71) Applicant: DOOSAN HEAVY INDUSTRIES & CONSTRUCTION CO., LTD., Changwon-si (KR)

(72) Inventors: Byeong Ha Jeon, Gimhae-si (KR); Moon Soo Cho, Seoul (KR)

(73) Assignee: Doosan Heavy Industries Construction Co., Ltd, Gyeongsangnam-do (KR)

( * ) Notice: Subject to any disclaimer, the term of this patent is extended or adjusted under 35 U.S.C. 154(b) by 126 days.

(21) Appl. No.: 16/110,707

(22) Filed: Aug. 23, 2018

(65) Prior Publication Data

US 2019/0072278 A1 Mar. 7, 2019

(30) Foreign Application Priority Data

Sep. 6, 2017 (KR) ..... 10-2017-0113879

(51) Int. Cl.
*F23R 3/00* (2006.01)
*F23R 3/28* (2006.01)
*F23R 3/60* (2006.01)

(52) U.S. Cl.
CPC ..... *F23R 3/283* (2013.01); *F23R 3/60* (2013.01); *F05D 2220/32* (2013.01); (Continued)

(58) Field of Classification Search
CPC ... F23R 3/283; F23R 3/60; F23R 2900/00014
See application file for complete search history.

(56) References Cited

U.S. PATENT DOCUMENTS 6,672,073 B2 1/2004 Wiebe
2009/0223225 A1* 9/2009 Kraemer ..... F02C 7/22 60/723
2012/0291451 A1* 11/2012 Moehrle ..... F23R 3/60 60/796

FOREIGN PATENT DOCUMENTS

JP 09-166176 A 6/1997
JP 2010054191 A 3/2010
(Continued)

OTHER PUBLICATIONS

A Korean Office Action dated Dec. 6, 2018 in connection with Korean Patent Application No. 10-2017-0113879 which corresponds to the above-referenced U.S. application.

*Primary Examiner* — Todd E Manahan
*Assistant Examiner* — Katheryn A Malatek
(74) *Attorney, Agent, or Firm* — Invenstone Patent, LLC

(57) ABSTRACT

A plate for supporting a plurality of nozzle tubes in a combustion casing of a combustor stably supports the nozzle tubes and adsorbs displacement due to thermal expansion or natural vibrations, thereby reducing combustor maintenance and extending the lifetime of the combustor. The plate includes an inner frame having a plurality of through holes for respectively receiving the plurality of nozzle tubes; a fixing frame fixed on an inner circumferential surface of the combustion casing and configured to support the inner frame; and a mechanical buffer disposed between the fixing frame and the inner frame. The fixing frame has an inner circumferential surface in which a fixing recess having a U-shaped cross-section is formed to receive the mechanical buffer and an outer edge of the inner frame and to receive the mechanical buffer. A method of assembly the nozzle tube support plate facilitates its initial installation and subsequent maintenance.

14 Claims, 10 Drawing Sheets

(52) U.S. Cl.
CPC ..... *F05D 2230/64* (2013.01); *F05D 2270/42* (2013.01); *F23R 2900/00014* (2013.01)

(56) References Cited

FOREIGN PATENT DOCUMENTS

| | | | |
|---|---|---|---|
| JP | 2013-257135 | A | 12/2013 |
| KR | 20140035415 | A | 3/2014 |

* cited by examiner

【FIG. 1】
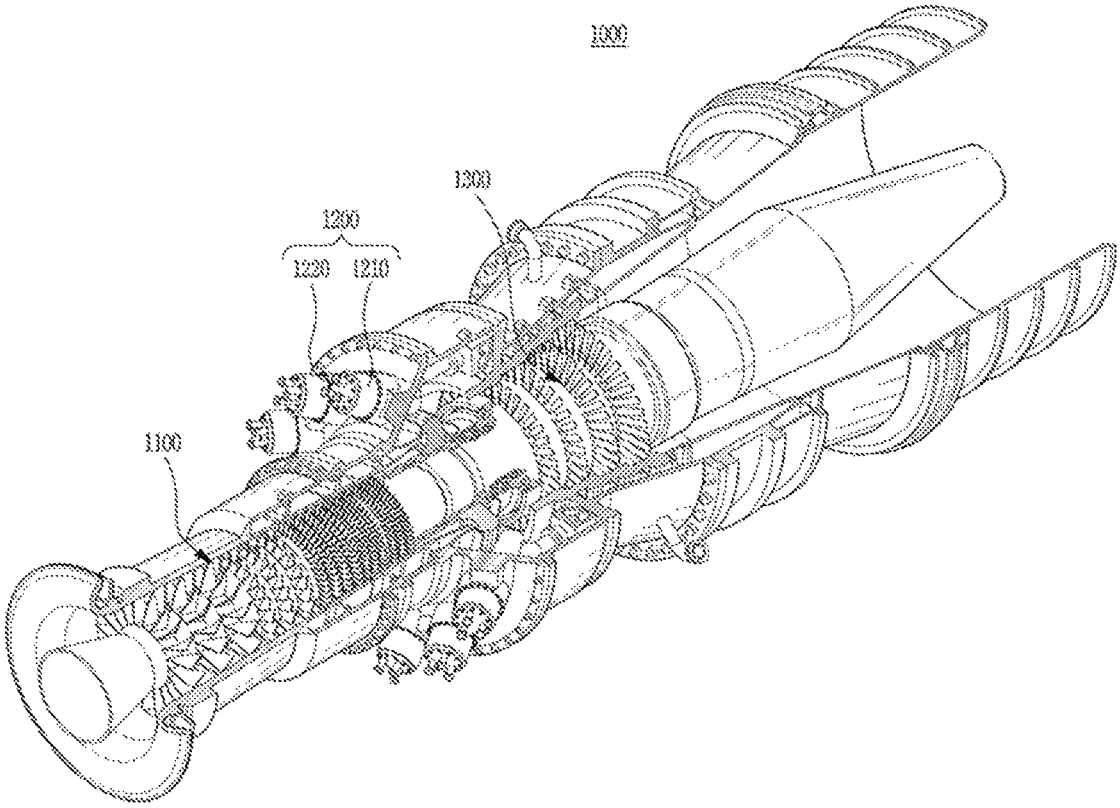

【FIG. 2】
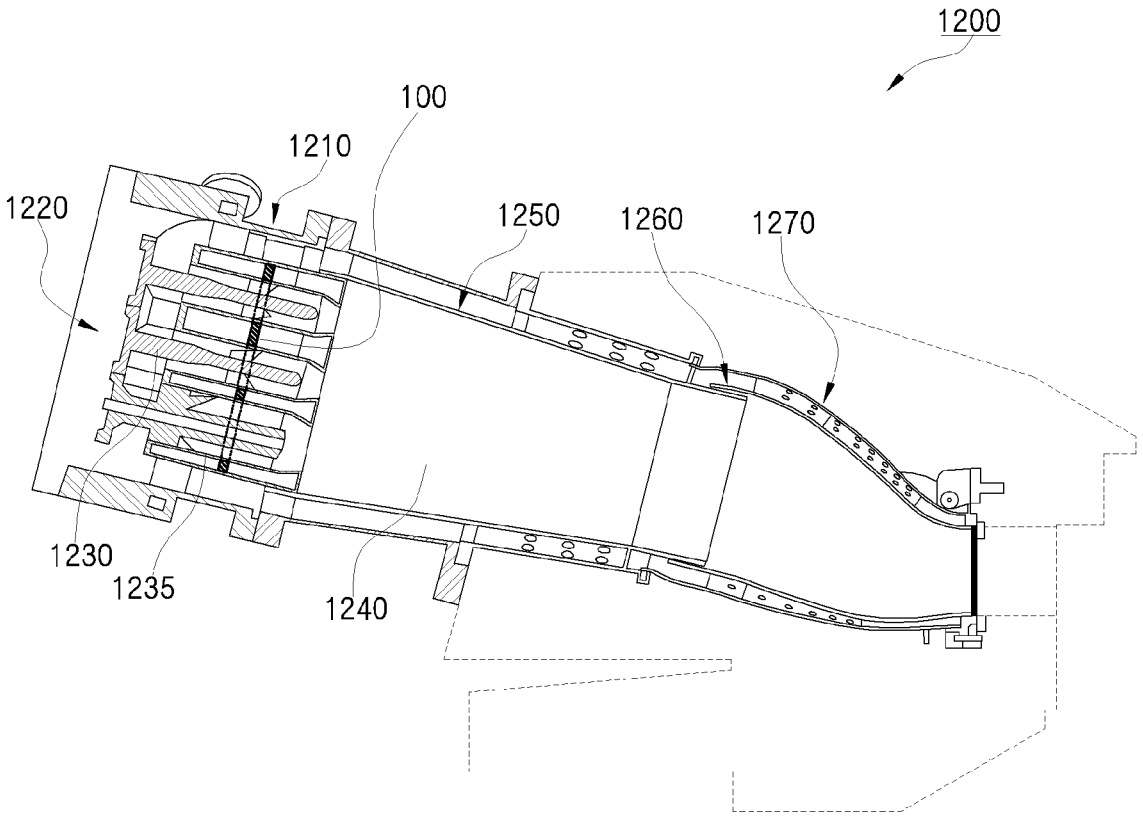

【FIG. 3】
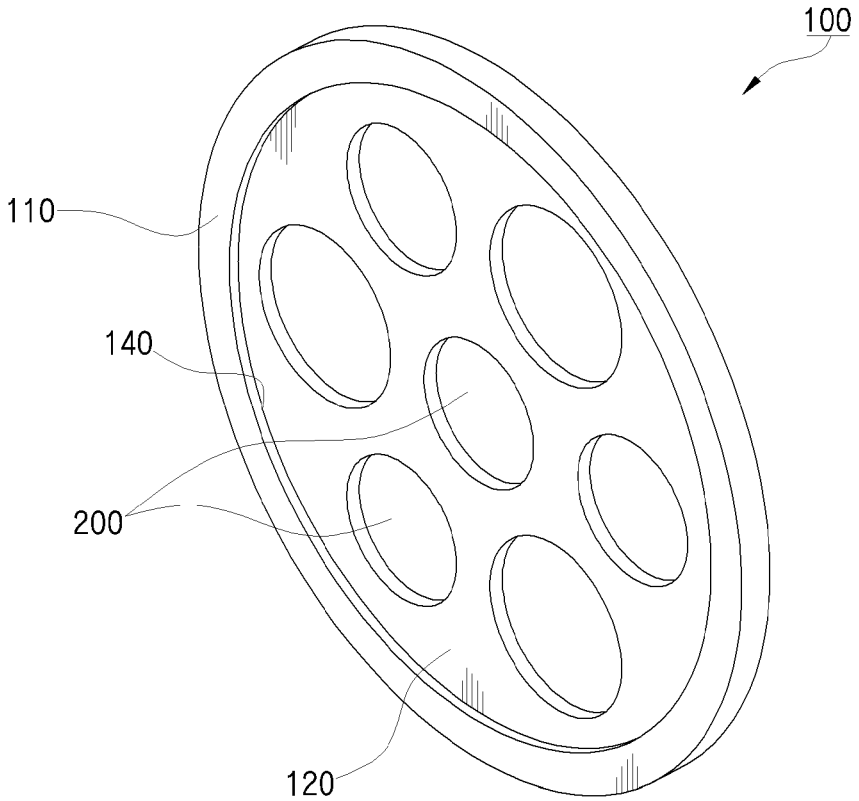

【FIG. 4】
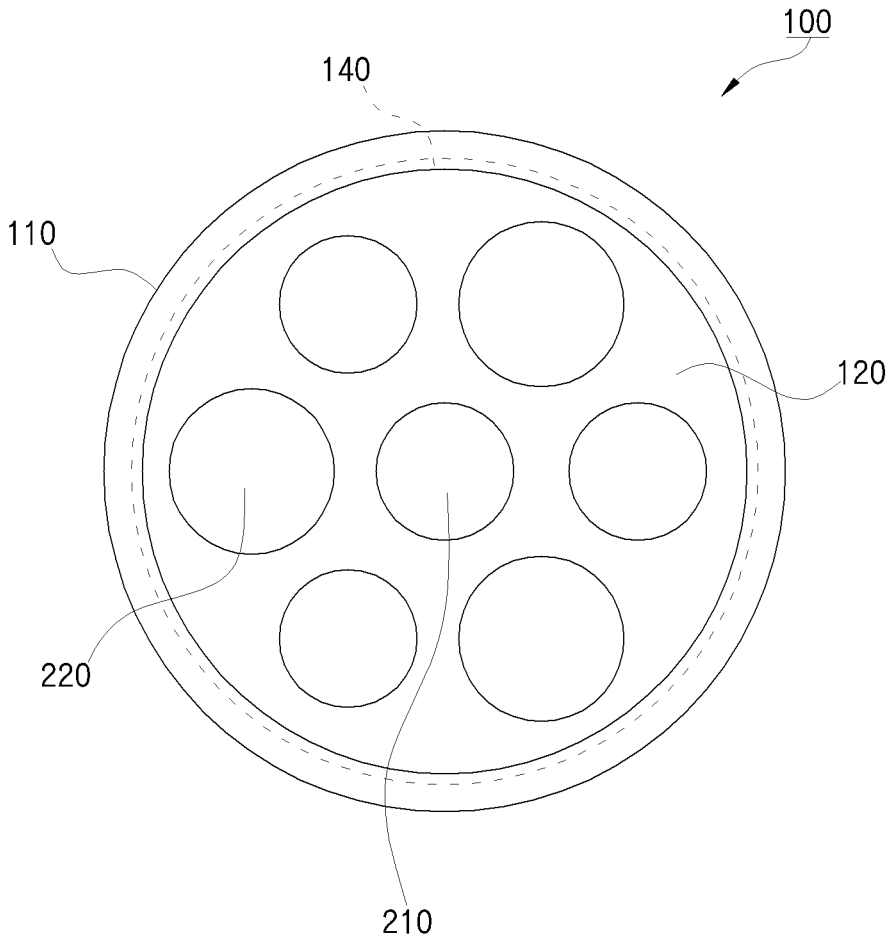

【FIG. 5】
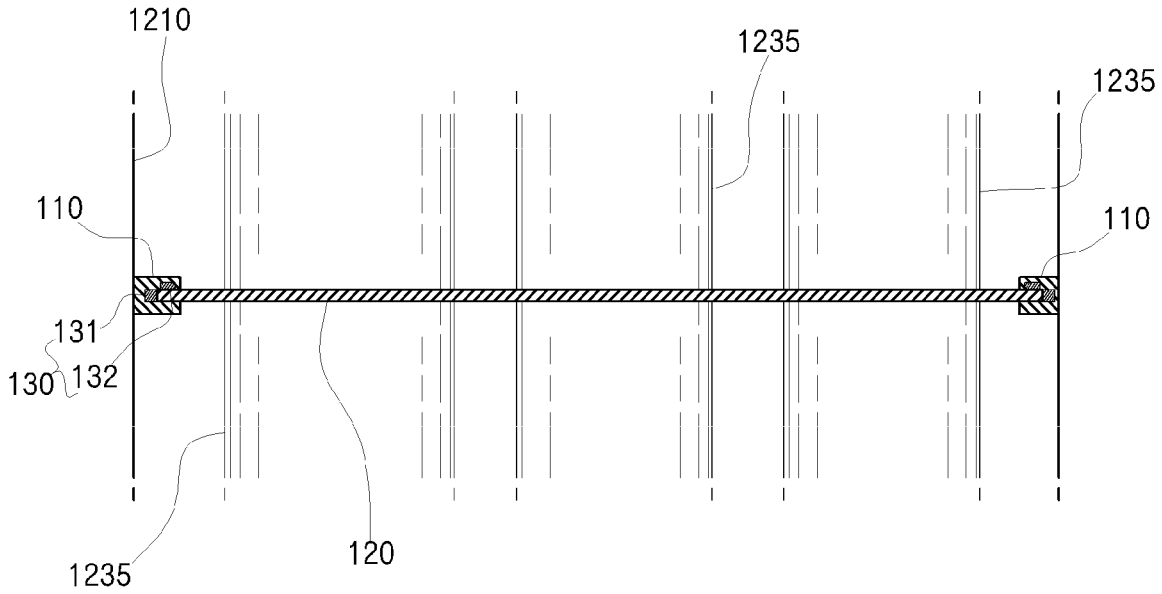

【FIG. 6】
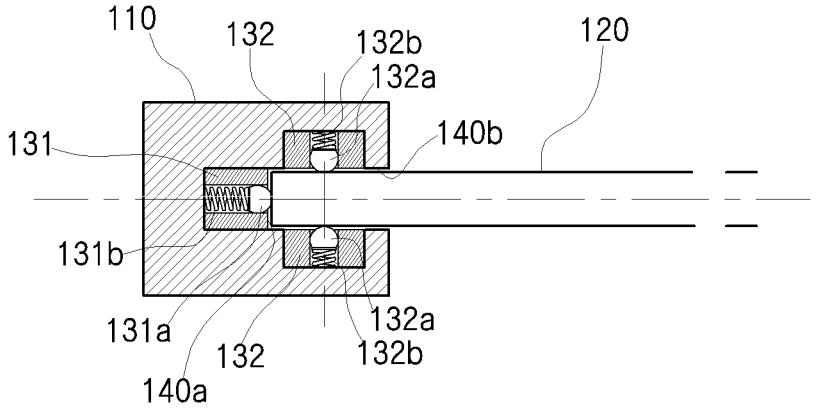

【FIG. 7A】
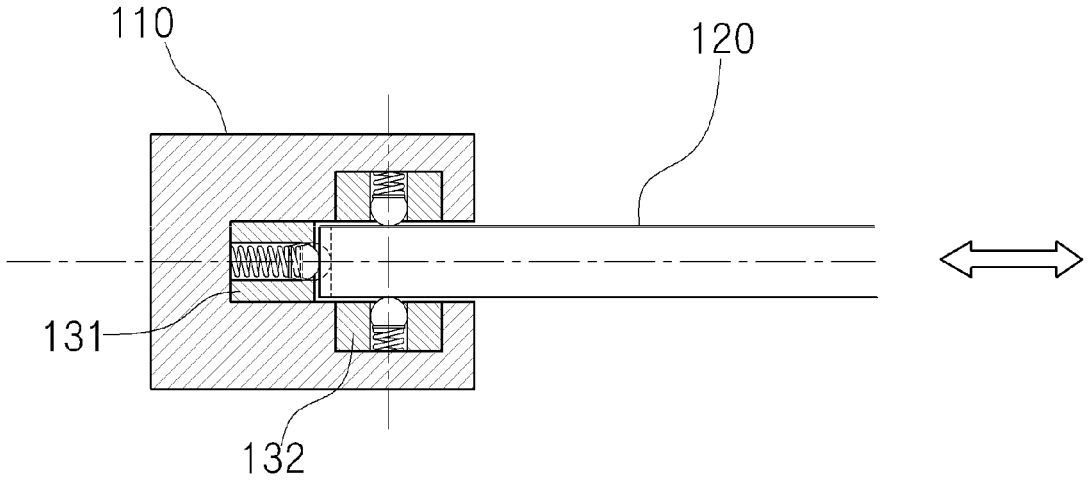
【FIG. 7B】
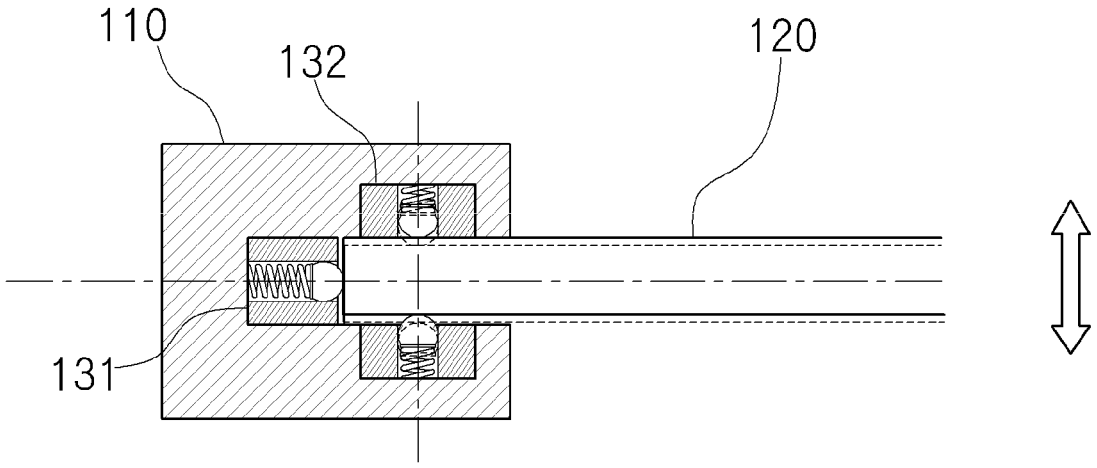

【FIG. 8】
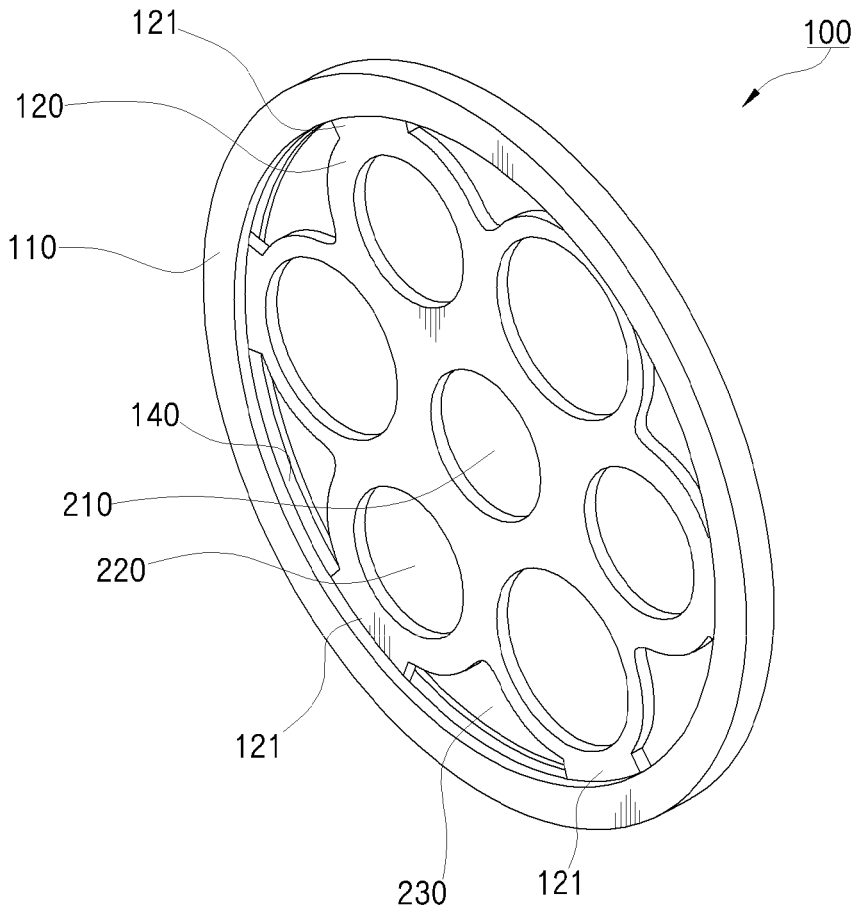

【FIG. 9】
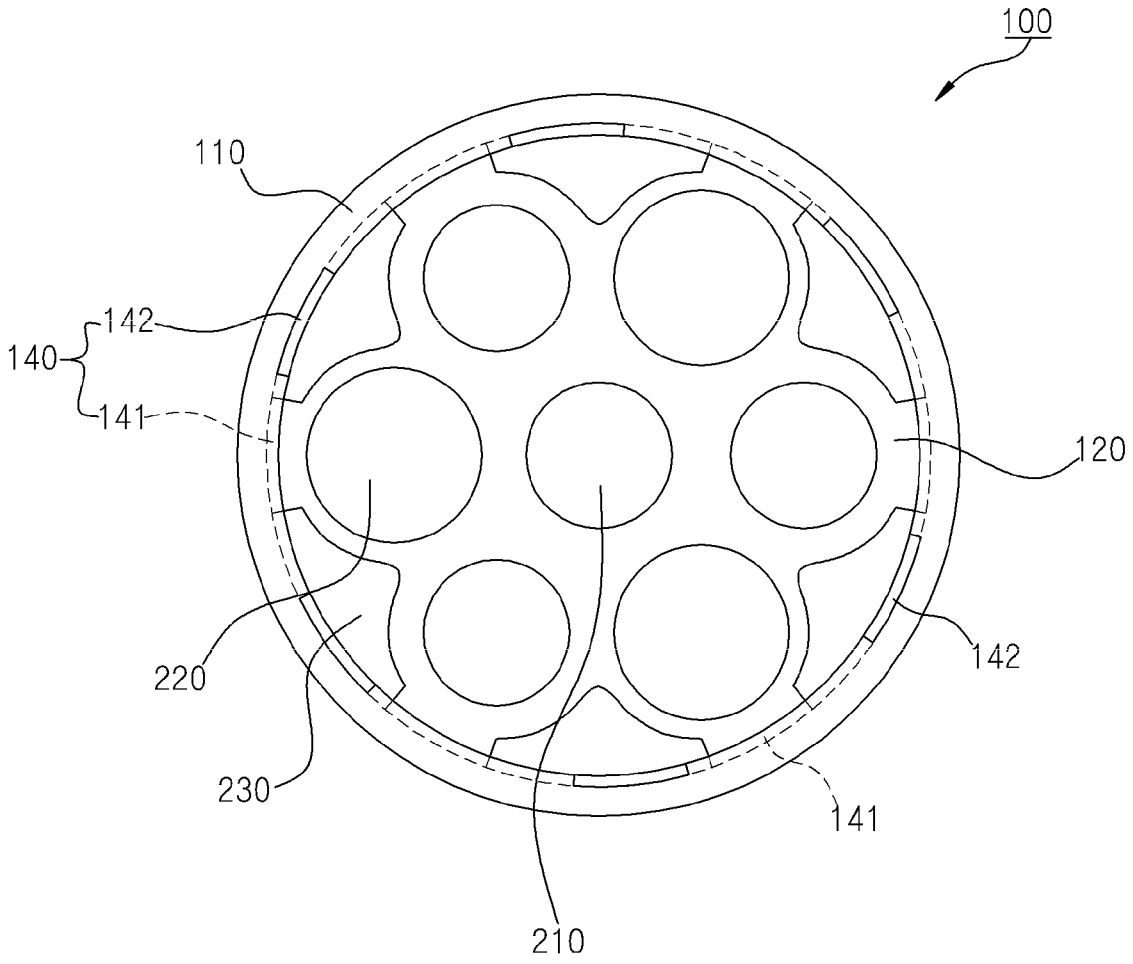

【FIG. 10A】
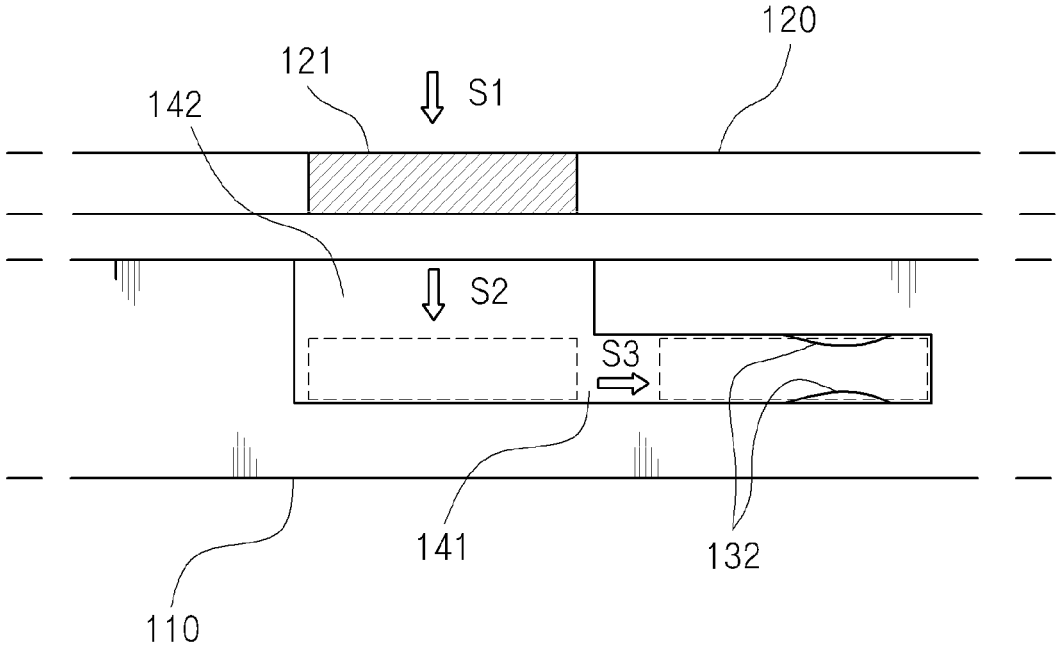
【FIG. 10B】
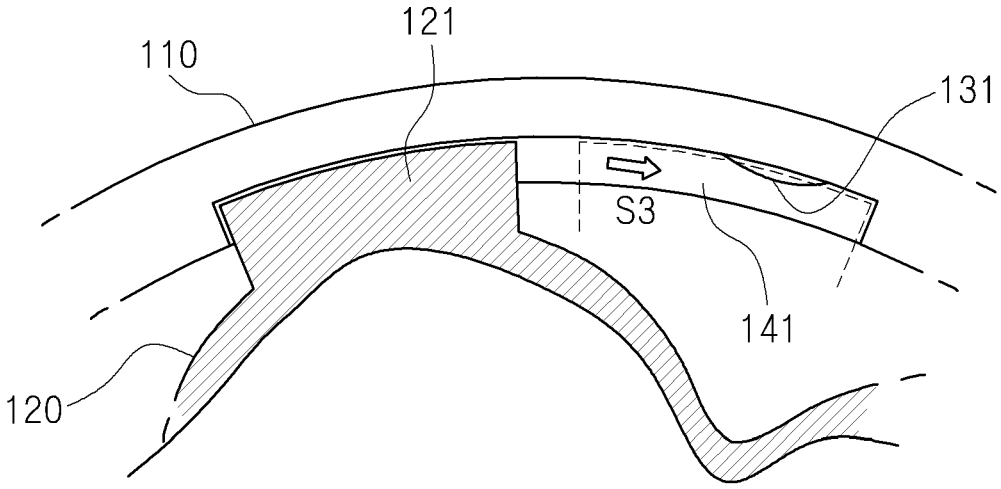

PLATE FOR SUPPORTING NOZZLE TUBES AND METHOD OF ASSEMBLING THE SAME

CROSS-REFERENCE TO RELATED APPLICATIONS

This application claims priority to Korean Patent Application No. 10-2017-0113879, filed on Sep. 6, 2017, the disclosure of which is incorporated herein by reference in its entirety.

BACKGROUND OF THE DISCLOSURE

Field of the Disclosure

Exemplary embodiments of the present disclosure relate to a gas turbine, and more particularly, to a structure for supporting nozzle tubes which is applied to a combustor for gas turbines, and a method of assembling the structure.

Description of the Related Art

A combustor for gas turbines is provided between a compressor and a turbine and functions to mix fuel with compressed air supplied from the compressor, to combust the mixture through an isobaric process to produce combustion gas having high energy, and to transmit the combustion gas to the turbine which converts thermal energy of the combustion gas into mechanical energy.

A casing of the combustor houses a plurality of injection nozzles and a plurality of nozzle tubes including the injection nozzles. The injection nozzles produce pre-mixed gas by mixing fuel with compressed air and supply the pre-mixed gas into a combustion chamber. The nozzle tubes are structures fixed to the casing of the combustor and, being disposed in a high-temperature region, are prone to thermal expansion. The nozzle tubes are also easily exposed to natural vibrations caused by the operation of the turbine and other factors.

In conventional techniques, a structure for supporting the plurality of nozzle tubes in the casing is configured in such a way that the support structure is fixed in the casing. Hence, the support structure may be damaged or broken due to a crack caused by thermal expansion or due to shocks resulting from natural vibrations. As a result, the lifetime of the combustor is reduced. Furthermore, a process of installing the support structure in the casing during assembly or disassembly (e.g., for maintenance) is inconvenient and cumbersome.

SUMMARY OF THE DISCLOSURE

An object of the present disclosure is to provide a plate for supporting nozzle tubes which functions not only to stably support the plurality nozzle tubes installed in a combustor for a gas turbine but also to reduce displacements due to thermal expansion or natural vibrations, thus reducing the need for maintenance of the combustor, and extending the lifetime of the combustor.

Another object of the present disclosure is to provide a plate for supporting nozzle tubes capable of facilitating assembly and disassembly of a nozzle tube support structure so that maintenance can be simply performed, and a method of assembling the plate.

In accordance with one aspect of the present disclosure, there is provided a plate for supporting a plurality of nozzle tubes in a combustion casing of a combustor. The plate may include an inner frame having a plurality of through holes for respectively receiving the plurality of nozzle tubes; a fixing frame fixed on an inner circumferential surface of the combustion casing and configured to support the inner frame; and a mechanical buffer disposed between the fixing frame and the inner frame In accordance with another aspect of the present disclosure, there is provided a combustor for a gas turbine. The combustor may include a plurality of nozzle tubes supported in a combustion casing; the above inner frame; the above fixing frame; and the above mechanical buffer.

In accordance with another aspect of the present disclosure, there is provided a method of assembling a plate for supporting a plurality of nozzle tubes in a combustion casing of a combustor. The method may include installing a fixing frame of the plate on an inner circumferential surface of the combustion casing; moving an inner frame of the plate in an axial direction of the combustor casing so that the inner frame approaches the fixing frame; axially inserting insert pieces formed at regular intervals on an outer edge of the inner frame, into auxiliary fixing recesses formed in an inner circumferential surface of the fixing frame; and rotating the inner frame such that each of the insert pieces of the inner frame is inserted into a U-shaped fixing recess of the fixing frame and is supported on a mechanical buffer seated on an inner surface of the U-shaped fixing recess.

The fixing frame may have an inner circumferential surface in which a fixing recess having a U-shaped cross-section is formed, and the fixing recess may be configured to receive an outer edge of the inner frame in order to support the inner frame. The fixing recess may be further configured to receive the mechanical buffer on an inner surface of the fixing recess.

The mechanical buffer may include a radial buffer configured to absorb a radial displacement of the inner frame with respect to the fixing frame; and an axial buffer configured to absorb an axial displacement of the inner frame with respect to the fixing frame.

The radial buffer may include a ball spring inserted into the fixing recess between the inner frame and a first inner surface of the fixing frame, and the axial buffer may include a ball spring inserted into the fixing recess between the inner frame and a second inner surface of the fixing frame.

The plate may further include insert pieces formed at regular intervals on the outer edge of the inner frame and configured to be respectively inserted into the fixing recess.

The inner circumferential surface of the fixing frame may include auxiliary fixing recesses formed in correspondence to the insert pieces of the inner frame, and the auxiliary fixing recesses may be configured to respectively receive an axial insertion of the insert pieces.

As a plate for supporting nozzle tubes in accordance with the present disclosure is applied to a combustor for a gas turbine, the plurality of nozzle tubes can be stably supported, and a crack due to thermal expansion of a structure or shocks resulting from natural vibrations can be mitigated. Consequently, the need for maintenance of the combustor due to damage to the structure can be reduced, and the lifetime of the combustor can be extended.

Furthermore, the present disclosure provides a method of assembling the nozzle tube support plate. Thus, the method facilitates both initial the installation of the nozzle tube support plate in the combustor and the maintenance of a coupling structure for supporting the plurality of nozzle tubes including the nozzle tube support plate.

The effects of the present disclosure are not limited to the above-stated effects, and those skilled in the art will clearly understand other not mentioned effects from the accompanying claims.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The above and other objects, features and other advantages of the present disclosure will be more clearly understood from the following detailed description taken in conjunction with the accompanying drawings, in which:

FIG. 1 is a cutaway perspective view of the overall structure of a gas turbine including a combustor, to which may be applied a plate for supporting nozzle tubes in accordance with the present disclosure;

FIG. 2 is a sectional view of a combustor for a gas turbine, in which may be included a plate for supporting nozzle tubes in accordance with the present disclosure;

FIG. 3 is a perspective view of a plate for supporting nozzle tubes in accordance with an embodiment of the present disclosure;

FIG. 4 is a front view of the nozzle tube support plate of FIG. 3;

FIG. 5 is a cross-sectional view of the nozzle tube support plate of FIG. 3 installed in a combustor as shown in FIG. 2;

FIG. 6 is an enlarged view of the nozzle tube support plate of FIG. 5, illustrating a junction of an inner frame and a fixing frame;

FIGS. 7A and 7B are views of the junction of FIG. 6, respectively illustrating radial and axial damping effects achieved by the nozzle tube support plate of FIG. 3;

FIG. 8 is a perspective view of a plate for supporting nozzle tubes in accordance with another embodiment of the present disclosure;

FIG. 9 is a front view of a plate for supporting nozzle tubes in accordance with yet another embodiment of the present disclosure; and FIGS. 10A and 10B are cross-sectional side and top views of the nozzle tube support plate of FIG. 9, respectively illustrating steps of a method of assembling a plate for supporting nozzle tubes in accordance with the present disclosure.

DESCRIPTION OF SPECIFIC EMBODIMENTS

Terms or words used hereinafter should not be construed as having common or dictionary meanings, but should be construed as having meanings and concepts that comply with the technical spirit of the present disclosure on the basis of the principle that the inventor may appropriately define the concepts of the terms in order to best describe his or her disclosure. Accordingly, the following description and drawings illustrate exemplary embodiments of the present disclosure and do not fully represent the scope of the present disclosure. It would be understood by one of ordinary skill in the art that a variety of equivalents and modifications of the embodiments exist.

Embodiments of the present disclosure are described in detail below with reference to the accompanying drawings.

In the drawings, the width, length, thickness, etc. of each element may have been enlarged for convenience. Furthermore, when it is described that one element is disposed 'over' or 'on' the other element, one element may be disposed 'right over' or 'right on' the other element or a third element may be disposed between the two elements. The same reference numbers are used throughout the specification to refer to the same or like parts.

Furthermore, the terms "first", "second", "A", "B", "(a)", "(b)", etc. may be used herein to describe various components of the embodiments of the present disclosure. These terms are only used to distinguish each component from another component, and do not limit the characteristics, turns, or sequences of the corresponding components. It is also noted that in this specification, "connected/coupled" refers to one component not only directly coupling another component but also indirectly coupling another component through an intermediate component.

The thermodynamic cycle of a gas turbine ideally complies with the Brayton cycle. The Brayton cycle consists of four processes including an isentropic compression (adiabatic compression) process, an isobaric heat supply process, an isentropic expansion (adiabatic expansion) process, and an isobaric heat rejection process. In other words, the gas turbine draws air from the atmosphere, compresses the air, combusts fuel under isobaric conditions to emit energy, expands this high-temperature combustion gas to convert the thermal energy of the combustion gas into kinetic energy, and thereafter discharges exhaust gas with residual energy to the atmosphere. As such, the Brayton cycle consists of four processes including compression, heat addition, expansion, and heat rejection. Embodying the Brayton cycle, the gas turbine includes a compressor, a combustor, and a turbine.

FIG. 1 illustrates the overall configuration of a gas turbine 1000. Although the following description will be made with reference to FIG. 1, the description of the present disclosure may also be widely applied to a turbine engine having the same or similar configuration as that of the gas turbine 1000.

The gas turbine 1000 includes a compressor 1100 functioning to draw air and compress the air. A main function of the compressor 1100 is to supply air for combustion to the combustor 1200 and supply air for cooling to a high-temperature region of the gas turbine 1000 which requires cooling. Drawn air is compressed in the compressor 1100 through an adiabatic compression process, which increases the pressure and the temperature of air passing through the compressor 1100.

The compressor 1100 is usually designed in the form of a centrifugal compressor or an axial compressor. Generally, the centrifugal compressor is used in a small gas turbine. On the other hand, in a large gas turbine such as the gas turbine 1000, a multi-stage axial compressor 1100 is generally used so as to compress a large amount of air.

The compressor 1100 is operated using some of power output from the turbine 1300. To this end, as shown in FIG. 1, a rotating shaft of the compressor 1100 is directly coupled with a rotating shaft of the turbine 1300. In the case of the large gas turbine 1000, almost half of the output produced by the turbine 1300 is consumed to drive the compressor 1100. Therefore, improvement in efficiency of the compressor 1100 has a direct and profound effect on increasing the overall efficiency of the gas turbine 1000.

FIG. 2 illustrates an example of the combustor 1200 provided in the gas turbine 1000. The combustor 1200 functions to mix fuel with compressed air supplied from an outlet of the compressor 1100 and combust the mixture through an isobaric combustion process to produce a combustion gas having high energy. Thus, the combustor 1200 is disposed downstream of the compressor 1100 and includes a plurality of burners 1220 disposed along a combustor casing 1210 having an annular shape. A plurality of combustion nozzles 1230 are provided in each burner 1220. Fuel ejected from the combustion nozzles 1230 is mixed with air at an appropriate ratio to form a mixture having conditions suitable for combustion.

The fuel utilized by the gas turbine 1000 may be a gas fuel, a liquid fuel, or a hybrid fuel combining these two. It is important to create combustion conditions for reducing the amount of exhaust gas such as carbon monoxide and nitrogen oxide, which may be subject to emission regulations. Recently, use of pre-mixed combustion has increased because a combustion temperature can be reduced and uniform combustion is possible so that exhaust gas can be reduced, although it is difficult to control pre-mixed combustion. In the case of the pre-mixed combustion, compressed air is mixed with fuel ejected from the combustion nozzles 1230 before entering the combustion chamber 1240. Initial ignition of pre-mixed gas is performed by an igniter. Thereafter, if combustion is stabilized, the combustion is maintained by supplying fuel and air.

There is a need to appropriately cool the combustor 1200 because the combustor 1200 forms the highest temperature environment in the gas turbine 1000. Referring to FIG. 2, compressed air flows along an outer surface of a duct assembly, which is coupled between the burner 1220 and the turbine 1300 so that high-temperature combustion gas flows through the duct assembly, in other words, along the outer surface of the duct assembly formed of a liner 1240, a transition piece 1260, and a flow sleeve 1270, and then is supplied toward the combustion nozzles 1230. During this process, the duct assembly heated by high-temperature combustion gas can be appropriately cooled.

The duct assembly has a double-shell structure, in which the flow sleeve 1270 encloses the outer surfaces of the liner 1250 and the transition piece 1260 that are coupled to each other by an elastic support unit. Compressed air enters an annular space defined in the flow sleeve 1270 and cools the liner 1250 and the transition piece 1260.

Here, because one end of the liner 1250 and one end of the transition piece 1260 are respectively fixed to the combustor 1200 and the turbine 1300, the elastic support unit should have a structure capable of absorbing length and diameter extension due to thermal expansion so as to reliably support the liner 1250 and the transition piece 1260.

High-temperature and high-pressure combustion gas generated from the combustor 1200 is supplied to the turbine 1300 through the duct assembly. In the turbine 1300, combustion gas expands through an adiabatic expansion process and collides with a plurality of blades radially disposed on the rotating shaft of the turbine 1300 so that reaction force is applied to the blades. Thus, thermal energy of the combustion gas is converted into mechanical energy by which the rotating shaft is rotated. Some of the mechanical energy obtained in the turbine 1300 is supplied as energy needed to compress air in the compressor, and the residual mechanical energy is used as valid energy for driving a generator to produce electric power, or the like.

As such, in the gas turbine 1000, major components do not reciprocate. Hence, mutual friction parts such as a piston-and-cylinder are not present, so that there are advantages in that there is little consumption of lubricant, the amplitude of vibration is markedly reduced unlike a reciprocating machine having high-amplitude characteristics, and high-speed driving is possible.

Furthermore, the thermal efficiency in the Brayton cycle increases, as the compression ratio at which air is compressed is increased and the temperature (turbine entrance temperature) of combustion gas drawn into the turbine through an isentropic expansion process is increased. Therefore, the gas turbine 1000 has been developed in such a way as to increase the compression ratio and the turbine entrance temperature.

Hereinafter, the nozzle tube support plate and a method of assembling the nozzle tube support plate in accordance with the present disclosure which is applied to the combustor 1200 of the gas turbine 1000 will be described in detail with reference to FIGS. 2 to 10.

FIG. 2 illustrates the combustor 1200 for gas turbines with an embodiment of the nozzle tube support plate 100 in accordance with the present disclosure.

Referring to FIG. 2, the nozzle tube support plate 100 is configured to stably support a plurality of nozzle tubes 1235. Here, each of the nozzle tubes 1235 includes a combustion nozzle 1230 and a shroud which encloses the combustion nozzle 1230. As described above, fuel ejected from the combustion nozzle 1230 is mixed with compressed air in the shroud, flows in a downstream direction, and enters the combustion chamber 1240.

The plurality of nozzle tubes 1235 may be arranged in such a way that a plurality of auxiliary tubes are disposed around a central tube. FIG. 2 illustrates the case where six auxiliary tubes are arranged by way of example. As described above, the plurality of nozzle tubes 1235 are disposed in the combustion casing 1210 of the burner 1220. Here, the nozzle tube support plate 100 in accordance with the present disclosure is provided in a medial portion of the combustion casing 1210 so that the central tube and the auxiliary tubes surrounding the central tube can be stably supported by the nozzle tube support plate 100, and, simultaneously, axial thermal expansion of each of the plurality of nozzle tubes 1235 can be independently absorbed by the nozzle tube support plate 100.

In the present disclosure, two or more nozzle tube support plates 100 may be provided depending on structural needs, taking into account the number of nozzle tubes 1235 in the casing 1210 of the combustor 1200 for gas turbines and the lengths of the nozzle tubes 1235.

FIG. 3 illustrates the overall configuration of an embodiment of the nozzle tube support plate 100 in accordance with the present disclosure, and FIGS. 4 and 5 are front and side views of the nozzle tube support plate 100 according to this embodiment.

Referring to FIGS. 3-5, the nozzle tube support plate 100 includes a fixing frame 110, an inner frame 120, and a mechanical buffer 130.

The fixing frame 110 is provided to form a fixing protrusion on an inner circumferential surface of the combustor casing 1210 having an annular shape. That is, the fixing frame 110 is fixed on the inner circumferential surface of the combustion casing 1210 and is configured to support the inner frame 120. The fixing frame 110 may be provided in the form of a ring that has a predetermined thickness and is formed along the inner circumferential surface of the combustor casing 1210.

The inner frame 120 is provided inside the fixing frame 110 and has a plurality of through holes 200 to receive the plurality of nozzle tubes 1235. The plurality of through holes 200 are formed corresponding to the positions and numbers of central tubes and auxiliary tubes. As such, the nozzle tube support plate 100 according to the present disclosure is formed of two structures that are physically independent from each other so that a radial or axial gap can be provided therebetween. Consequently, the structures of the nozzle tube support plate 100 according to the present disclosure can absorb relative displacement due to thermal expansion or the like.

Here, the term "radial direction" refers to the direction of a normal of a central axis of the combustor casing 1210, i.e., a direction from the center outward in FIG. 4 and corresponding to a left-right direction in FIG. 5. The term "axial direction" refers to a longitudinal direction of the nozzle tube 1235 in the combustor casing 1210, i.e., an up-down direction in FIG. 5.

The mechanical buffer 130 is provided between the fixing frame 1100 and the inner frame 120.

The casing 1210 of the combustor and the plurality of nozzle tubes 1235 are fixed structures and receive a comparatively large amount of vibrations due to rotation of a rotor of the turbine 1300, so that if stress concentration due to the vibrations is accumulated, the structures may be damaged or broken. In the present disclosure, the mechanical buffer 130 is provided in the gap between the fixing frame 110 and the inner frame 120, thus actively damping main vibrations which are unavoidably generated in the gas turbine.

Referring to FIGS. 4 and 5, the inner frame 120 has the plurality of through holes 200 such that the plurality of nozzle tubes 1235 can independently slide, e.g., when the nozzle tubes 1235 thermally expand. The through holes 200 may be variously configured corresponding to the arrangement of the nozzle tubes 1235. In an embodiment, auxiliary through holes 220, through which the plurality of auxiliary tubes respectively pass, may be formed around a central through hole 210, through which the central tube passes.

Furthermore, a fixing recess 140 having a U-shaped cross-section is formed in an inner circumferential surface of the fixing frame 110 so that an outer edge of the inner frame 120 can be reliably inserted into and supported in the fixing frame 110. In other words, in the case where the inner frame 120 is assembled and installed in the inner circumferential surface of the fixing frame 110, the inner frame 120 can be prevented from being physically removed from the fixing frame 110, thus making it possible to stably support the plurality of nozzle tubes 1235. Likewise, even when the outer edge of the inner frame 120 is formed of insert pieces 121, which will be described later herein, the fixing frame 110 can absorb radial or axial displacement of the inner frame 120 due to thermal expansion or the like, and prevent the inner frame 120 from being completely removed from the fixing frame 110.

Referring to FIG. 5, the mechanical buffer 130 is provided on an inner surface of the fixing recess 140 of the fixing frame 110 so as to prevent a crack from occurring in the fixing frame 110 or the inner frame 120 because of thermal expansion or absorb shocks caused by natural vibrations of the turbine 1300, etc. The mechanical buffer 130 may also be provided on the outer edge of the inner frame 120 depending on productivity or structural needs.

FIG. 6 details the junction of the fixing frame 110 and the inner frame 120 in accordance with the present embodiment.

Referring to FIG. 6, the mechanical buffer 130 includes a radial buffer 131 configured to damp a radial displacement, and an axial buffer 132 configured to damp an axial displacement.

In detail, the radial buffer 131 is provided on a first inner surface 140*a* of the fixing recess 140 to absorb a radial displacement. Thus, the first inner surface 140*a* is a surface of the fixing frame 110 that is configured to receive a radial movement of the inner frame 120. The axial buffer 132 is provided on a second inner surface 140*b* of the fixing recess 140 to absorb an axial displacement. Thus, the second inner surface 140*b* is a surface of the fixing frame 110 that is configured to receive an axial movement of the inner frame 120.

Referring to FIG. 6, the second inner surface 140*b* of the fixing recess 140 may be formed in such a way that opposite surfaces of the fixing recess 140 are symmetrical with each other. The axial buffer 132 may be provided in either or both of the opposite surfaces depending on the productivity or structural needs.

In an embodiment, each of the radial buffer 131 and the axial buffer 132 may be formed of a ball spring. FIG. 6 illustrates the embodiment of the first and axial buffers 131 and 132 each of which is formed of a ball spring. The radial and axial buffers 131 and 132 each have a buffer structure in which a ball 131*a* or 132*a* is coupled to a spring 131*b* or 132*b*, thus coping with displacements caused by radial and axial vibrations or the like. In addition to a ball spring, other alternative mechanical buffers such as a plate spring or a torsion bar may be used although not shown.

FIGS. 7A and 7B respectively illustrate the radial damping effect and the axial damping effect of the nozzle tube support plate 100 in accordance with the present disclosure.

Referring to FIGS. 6 and 7A, a natural vibration comprises both radial vibration and an axial vibration, where the radial vibration may be considered as main vibration, whereas the axial vibration may be considered as not main vibration. As it can be seen it from the FIGS. 6 and 7A, because radial vibrations (i.e., main vibrations) generated by the operation of the gas turbine typically correspond to radial displacements, the radial buffer 131 is formed of the spring 131*b* with the ball 131*a* on the first inner surface 140*a* of the fixing recess 140. One end of the spring 131*b* is fixed with respect to an inner surface of the fixing frame 110, which is perpendicular to the axial direction, and the other end supports the ball 131*a* that comes into direct contact with the outer edge of the inner frame 120. Thus, the radial buffer 131 may mainly buffer or damp radial vibrations.

Referring to FIGS. 6 and 7B, because, in addition to the radial vibrations, axial vibrations (i.e., not main vibrations) which are smaller than the radial vibrations (i.e., main vibrations) may be generated by the operation of the gas turbine, the axial buffer 132 is formed of the spring 132*b* with the ball 132*a* on one surface or each of the opposite surfaces of the second inner surface 140*b* of the fixing recess 140. One end of the spring 132*b* is fixed with respect to an inner surface of the fixing frame 110, which is parallel to the axial direction, and the other end supports the ball 132*a* that comes into direct contact with the outer edge of the inner frame 120. Thus, the axial buffer 132 may mainly buffer or damp not only radial but also axial vibrations.

Here, the mechanical buffer 130 is not limited to a ball spring structure because it is sufficient if the mechanical buffer 130 is provided on the inner surface of the fixing recess 140 of the fixing frame 110 and is able to damp physical displacements of the fixing frame 110. For example, taking into account productivity and requirements of those skilled in this art, any one or all of the mechanical buffers 130 may have a plate spring structure or the like.

FIG. 8 shows the overall configuration of another embodiment of the nozzle tube support plate 100 in accordance with the present disclosure.

Referring to FIG. 8, with regard to the shape of the inner frame 120, the outer edge of the inner frame 120 is formed to have a predetermined thickness along a perimeter of the auxiliary through holes 220. Thereby, cooling through holes 230 are formed in a boundary region (edge region) of the inner frame 120 and the fixing frame 110, whereby the supply of cooling air can be facilitated.

Furthermore, insert pieces 121 are formed on the outer edge of the inner frame 120 at regular intervals along a circumferential direction so that the outer edge of the inner frame 120 can be reliably inserted into and supported in the U-shaped recess 140 formed in the inner circumferential surface of the fixing frame 110.

FIG. 9 shows the nozzle tube support plate 100.

Referring to FIG. 9, in the inner circumferential surface of the fixing frame 110, main recesses 141 may be further formed inside of auxiliary recesses 142 so that the insert pieces 121 of the inner frame 120 can be inserted into the fixing frame 110 in the axial direction. Therefore, when the nozzle tube support plate 100 is initially installed on the inner circumferential surface of the combustor casing 1210, or when the nozzle tube support plate 100 and the combustor casing 1210 are disassembled and reassembled during maintenance of the gas turbine, the process can be facilitated.

Referring to FIGS. 10A and 10B, illustrating an assembly process of the nozzle tube support plate 100 of FIG. 9, the inner frame 120 is first moved in the axial direction of the combustor casing 1210 toward the fixing frame 110 installed to form the fixing protrusion on the inner circumferential surface of the annular combustion casing 1210 so that the inner frame 120 approaches the fixing frame 110 (see arrow 51 of FIG. 10B).

Thereafter, the insert pieces 121 that are provided along the circumferential direction on the outer edge of the inner frame 120 at regular intervals are axially inserted into the respective auxiliary recesses 142 formed in the inner circumferential surface of the fixing frame 110 (see arrow S2 of FIG. 10A).

Subsequently, the inner frame 120 is rotated such that the inert pieces 121 are inserted into and supported on the mechanical buffers 130 provided on the inner surface of the U-shaped recess 140 of the fixing frame 110 (see arrow S3 of FIGS. 10A and 10B).

As described above, as the present disclosure is applied to the combustor 1200 for gas turbines, the plurality of nozzle tubes 1235 can be stably supported, and a crack due to thermal expansion of the structure or shocks resulting from natural vibrations can be mitigated. Consequently, the need for maintenance of the combustor due to damage to the structure can be reduced, and the lifetime of the combustor can be extended.

Furthermore, when the nozzle tube support plate 100 is initially installed in the combustor 1200 or an assembly or disassembly process is performed for maintenance of the coupling structure for supporting the plurality of nozzle tubes 1235 including the nozzle tube support plate 100 of the present disclosure, the process can be rapidly and simply performed.

While the plate for supporting the nozzle tubes and the method of assembling the plate in accordance with the present disclosure have been described with respect to the specific embodiments, it will be apparent to those skilled in the art that various changes and modifications may be made without departing from the spirit and scope of the disclosure as defined in the following claims.

Therefore, it should be understood that the exemplary embodiments are only for illustrative purposes and do not limit the bounds of the present invention.

What is claimed is:

1. A plate for supporting a plurality of nozzle tubes in a combustion casing of a combustor of a gas turbine, the plate comprising:

an inner frame having a plurality of through holes for respectively receiving the plurality of nozzle tubes;

a fixing frame fixed on an inner circumferential surface of the combustion casing and configured to support the inner frame, the fixing frame having an inner circumferential surface in which a fixing recess is formed, the fixing recess having a U-shaped cross-section and being configured to receive an outer edge of the inner frame in order to support the inner frame; and a mechanical buffer disposed between the fixing frame and the inner frame.

2. The plate according to claim 1, the fixing recess is further configured to receive the mechanical buffer on an inner surface of the fixing recess.

3. The plate according to claim 2, wherein the mechanical buffer comprises:

a radial buffer configured to absorb a radial displacement of the inner frame with respect to the fixing frame; and an axial buffer configured to absorb an axial displacement of the inner frame with respect to the fixing frame.

4. The plate according to claim 3, wherein the radial buffer comprises a ball spring inserted into the fixing recess between the inner frame and a first inner surface of the fixing frame.

5. The plate according to claim 3, wherein the axial buffer comprises a ball spring inserted into the fixing recess between the inner frame and a second inner surface of the fixing frame.

6. The plate according to claim 1, further comprising insert pieces formed at regular intervals on the outer edge of the inner frame and configured to be respectively inserted into the fixing recess.

7. The plate according to claim 6, wherein the inner circumferential surface of the fixing frame includes auxiliary fixing recesses formed to correspond to the insert pieces of the inner frame, and the auxiliary fixing recesses are configured to respectively receive an axial insertion of the insert pieces.

8. A combustor for a gas turbine, the combustor comprising:

a plurality of nozzle tubes supported in a combustion casing;

an inner frame having a plurality of through holes for respectively receiving the plurality of nozzle tubes;

a fixing frame fixed on an inner circumferential surface of the combustion casing and configured to support the inner frame, the fixing frame having an inner circumferential surface in which a fixing recess is formed, the fixing recess having a U-shaped cross-section and being configured to receive an outer edge of the inner frame in order to support the inner frame; and a mechanical buffer disposed between the fixing frame and the inner frame.

9. The combustor according to claim 8, the fixing recess is further configured to receive the mechanical buffer on an inner surface of the fixing recess.

10. The combustor according to claim 9, wherein the mechanical buffer comprises:

a radial buffer configured to absorb a radial displacement of the inner frame with respect to the fixing frame; and an axial buffer configured to absorb an axial displacement of the inner frame with respect to the fixing frame.

11. The combustor according to claim 10, wherein the radial buffer comprises a ball spring inserted into the fixing recess between the inner frame and a first inner surface of the fixing frame.

12. The combustor according to claim 10, wherein the axial buffer comprises a ball spring inserted into the fixing recess between the inner frame and a second inner surface of the fixing frame.

13. The combustor according to claim 8, further comprising insert pieces formed at regular intervals on the outer edge of the inner frame and configured to be respectively inserted into the fixing recess.

14. The combustor according to claim 13, wherein the inner circumferential surface of the fixing frame includes auxiliary fixing recesses formed to correspond to the insert pieces of the inner frame, and the auxiliary fixing recesses are configured to respectively receive an axial insertion of the insert pieces.

* * * * *